United States Patent [19]

Sarcia

[11] Patent Number: 4,520,630

[45] Date of Patent: Jun. 4, 1985

[54] CRYOGENIC REFRIGERATOR AND HEAT SOURCE

[75] Inventor: Domenico S. Sarcia, Carlisle, Mass.

[73] Assignee: CVI Incorporated, Hilliard, Ohio

[21] Appl. No.: 586,575

[22] Filed: Mar. 6, 1984

[51] Int. Cl.[3] ..... F25B 9/00

[52] U.S. Cl. ..... 62/6; 60/520

[58] Field of Search ..... 62/6, 55.5; 60/520

[56] References Cited

U.S. PATENT DOCUMENTS

| | | | |
|---|---|---|---|
| 2,966,035 | 12/1960 | Gifford | 62/6 |
| 3,188,818 | 6/1965 | Hogan | 62/6 |
| 3,218,815 | 11/1965 | Chellis et al. | 62/6 |
| 4,305,741 | 12/1981 | Sarcia | 62/6 |
| 4,339,927 | 7/1982 | Sarcia | 62/6 |
| 4,388,809 | 6/1983 | Sarcia | 62/6 |
| 4,438,631 | 3/1984 | Sarcia | 62/6 |

*Primary Examiner*—Ronald C. Capossela

*Attorney, Agent, or Firm*—Seidel, Gonda, Goldhammer

[57] ABSTRACT

The cryogenic refrigerator includes a movable displacer within an enclosure having first and second chambers of variable volume. A refrigerant fluid is circulated in a fluid path between said chambers and correlated with movement of the displacer. A spool valve controls introduction of high pressure fluid and low pressure fluid to said chambers. The displacer movement is controlled by an electric motor which has a cam for reciprocating the spool valve member. The refrigerator is converted into a source of heat by reversing the direction of rotation of said electric motor.

12 Claims, 5 Drawing Figures

CRYOGENIC REFRIGERATOR AND HEAT SOURCE

BACKGROUND

The present invention is an improvement on the Gifford-McMahon cycle. Familiarity with said cycle is assumed. Representative prior art patents teaching such cycle include U.S. Pat. Nos. 2,966,035; 3,188,818; 3,218,815; and 4,305,741; 4,339,927; 4,388,809.

For maximum efficiency and reliability, it is important to have maximum gas volume transfer through the regenerator. In order that this may be attained, it is important that the direction of gas flow be reversed when the displacer is at top dead center or bottom dead center. The present invention is directed to a solution of the problem of how to convert a refrigerator having those features to a source of heat.

SUMMARY OF THE INVENTION

The present invention is directed to a cryogenic refrigerator in which a movable displacer defines within an enclosure first and second chambers of variable volume. A refrigerant fluid is circulated in a fluid flow path between the first chamber and the second chamber and correlated with movement of the displacer.

The refrigerator includes chamber means for guiding a slide connected to the displacer. An electric motor is connected to the slide for controlling movement of the displacer. A valve is provided with a valve member for controlling flow of the high and low pressure fluid. The valve member is reciprocated by a cam driven by said electric motor.

It is an object of the present invention to provide a cryogenic refrigerator that may be converted to a heat pump in an inexpensive facile manner.

Other objects and advantages will appear hereinafter.

For the purpose of illustrating the invention, there is provided in the drawings a form which is presently preferred; it being understood, however, that this invention is not limited to the precise arrangements and instrumentalities shown.

DETAILED DESCRIPTION

Figure 1:
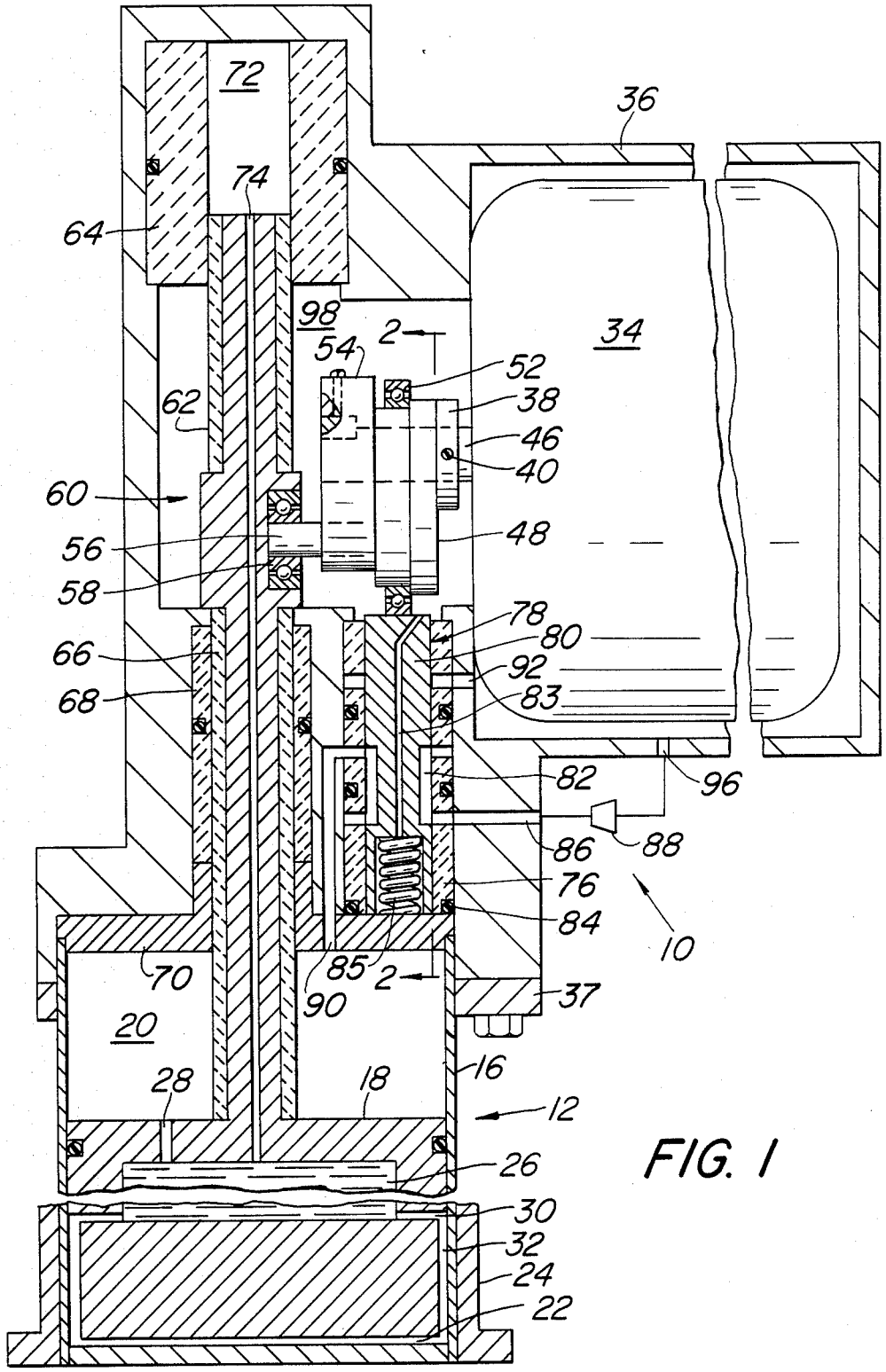
FIG. 1 is a vertical sectional view of a refrigerator in accordance with the present invention with the displacer at bottom dead center.

Referring to the drawings in detail, wherein like numerals indicate like elements, there is shown a refrigerator in accordance with the present invention designated generally as 10. As illustrated, the refrigerator 10 has a first stage 12. It is within the scope of the present invention to have one or more stages. When in use, the stages are disposed within a vacuum housing not shown. Each stage includes a housing 16 within which is provided a displacer 18. The displacer 18 has a length less than the length of the housing 16 so as to define a warm chamber 20 thereabove and a cold chamber 22 therebelow. The designations warm and cold are relative as is well known to those skilled in the art.

Within the displacer 18, there is provided a regenerator 26 containing a matrix. Ports 28 communicate the upper end of the matrix in regenerator 26 with the warm chamber 20. Radially disposed ports 30 communicate the lower end of the matrix in regenerator 26 with a clearance space 32 disposed between the outer periphery of the lower end of the displacer 18 and the inner periphery of the housing 16. Thus, the lower end of the matrix in regenerator 26 communicates with cold chamber 22 by way of ports 30 and clearance 32 which is an annular gap heat exchanger.

The matrix in regenerator 26 is preferably a stack of 250 mesh material having high specific heat such as oxygen-free copper. The matrix has low void area and low pressure drop. The matrix may be other materials such as lead spheres, nylon, glass, etc.

Figure 4:
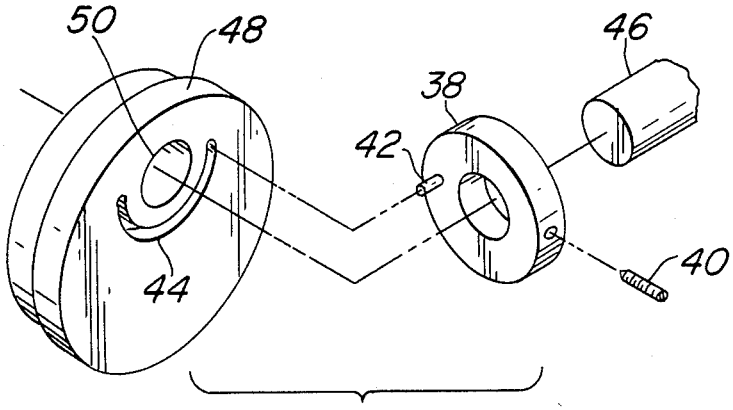
FIG. 4 is an exploded view of the cam and its drive.

An electrical motor 34, such as a reversible synchronous stepper motor, is disposed within housing 36. Housing 16 depends downwardly from and has a flange 37 bolted to housing 36. The output shaft 46 of motor 34 is provided with a collar 38 adjustably attached thereto by set screw 40. Collar 38 has a pin 42 extending parallel to shaft 46. Pin 42 extends into groove 44 on cam 48. The hole 50 and groove 44 are coaxial. See FIG. 4. Groove 44 has an arcuate length of 180°. A roller bearing 52 is attached to the periphery of cam 48.

A crank 54 is attached to shaft 46 by a key and set screw. Crank 54 is coupled to cam 48 by adjustable ball detent 53. The detent housing is threaded to the crank 54 and contains a ball spring biased into a recess on a side face of cam 48. See FIG. 3. Crank 54 has a crank pin 56. The axis of crank pin 56 is spaced from and parallel to the axis of shaft 46. Crank pin 56 has a roller bearing 58 disposed within a transverse slot on slide 60. Slide 60 is connected to the upper end of the displacer 18.

The slide 60 has a cylindrical bearing insert 62 guided by clearance seal sleeve bearing 64. The slide 60 also has a cylindrical bearing insert 66 guided by clearance seal sleeve bearing 68. The bearing inserts and sleeve bearings are preferably made from a ceramic material or other hard material such as silicon carbide. The sleeve bearing 68 is held in place by a retainer 70 connected to the housing 36. A chamber 72 within sleeve bearing 64 communicates with the regenerator 26 by way of an axial flow passage 74 in the slide 60. Passage 74 prevents air from being compressed within chamber 72 as the slide 60 moves upwardly. Hence, slide 60 is gas balanced when its diameter is uniform at its ends.

The housing 36 includes a bore parallel to the slide 60. Within the bore there is provided a clearance seal sleeve bearing 76 preferably made from a ceramic material. Within the sleeve bearing 76, there is provided a spool valve designated generally as 78. The valve 78 includes a cylindrical spool valve member 80 having a groove 82 on its outer periphery between its ends. Groove 82 renders valve member 80 gas-balanced. Member 80 has an axially extending equalizing passage 83. A seal 84 is provided between the bearing 76 and the retainer 70. O-ring seals are preferably provided on elements 18, 64, 68, and 76 as shown in FIG. 1.

Roller bearing 52 on cam 48 engages the upper end of the valve member 80. A coil spring 85 extends between retainer 70 and valve member 80 for biasing the valve member into contact with roller bearing 52 on cam 48. The valve member 80 is moved downwardly by the cam 48 and is moved upwardly by expansion of the spring 85.

Referring to FIG. 1, high pressure is introduced into port 86 from the outlet side of a compressor 88. Port 86 communicates with the groove 82 when the valve member 80 is in the position as shown in FIG. 1. When valve member 80 is in the position as shown in FIG. 1, groove 82 also communicates with warm chamber 20 by way of passage 90.

A port 92 extends from the interior of housing 36 and is blocked by the valve member 80 in the position of the latter shown in FIG. 1. When the valve member 80 is in its uppermost position, the groove 82 communicates passage 90 with port 92. The interior of the housing 36 communicates with the inlet side of compressor 94 by way of port 96. Chamber 98 is in direct communication with the interior of housing 36. The flow of a refrigerant from port 92 to port 96 has a cooling effect on the motor 34. If desired, port 92 may be eliminated by causing groove 68 to communicate with chamber 98 at the top dead center position of valve member 80. It will be noted that the axial length of groove 82 is less than the axial distance between ports 86 and 92 to thereby minimize leakage of high pressure gas between said ports and passage 90.

The housing 36 is constructed of a number of components so as to facilitate machining, assembly, access to the valve member 80 and slide 60. The manner in which the housing 36 is comprised of a plurality of components is not illustrated but will be obvious to those skilled in the art.

Figure 2:
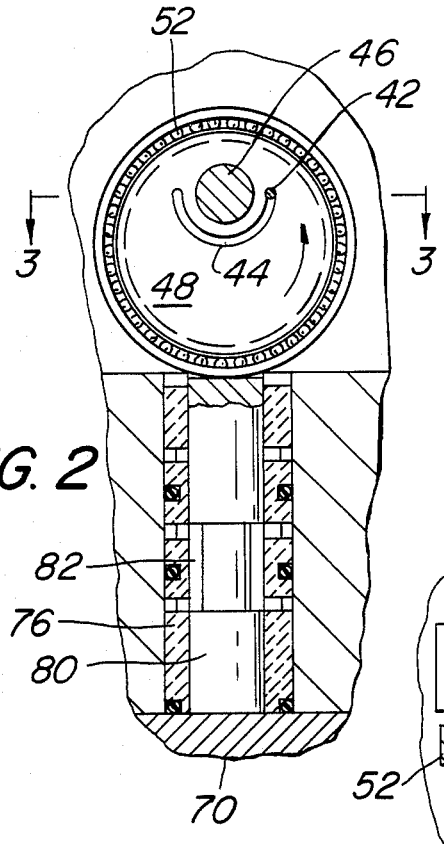
FIG. 2 is a view taken along the line 2—2 in FIG. 1.
Figure 5:
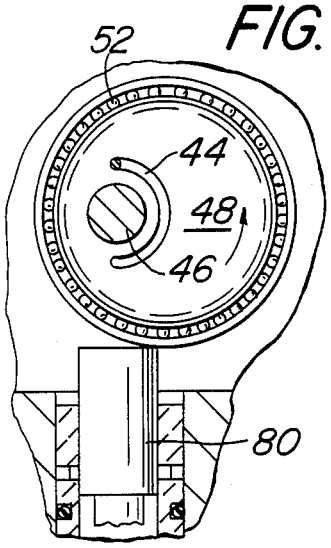
FIG. 5 is a view similar to FIG. 2 but with the cam rotated 90° counter clockwise.
Figure 3:
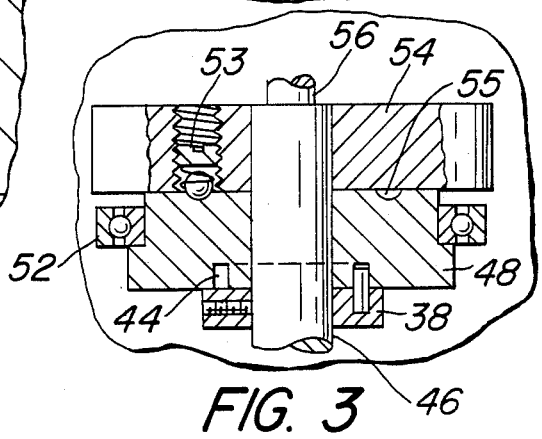
FIG. 3 is a view of the cam member taken along the line 3—3 in FIG. 2.

Pin 42 drives cam 48 in a counter clockwise direction in FIG. 2 during the refrigeration cycle. When cam 48 is in the position shown in FIG. 5 it contacts valve member 80 adjacent the periphery of the latter. At that point in time, the upward force of spring 85 (minus the friction forces on valve member 80) creates a moment about the axis of shaft 46 which tends to cause pin 42 to lost contact with the end of groove 44. That would create erratic timing of operation of the valve 78. The ball detent 53 resists the spring force moment to prevent such erratic timing regardless of the direction of rotation of cam 48. The side face of cam 48 juxtaposed to crank 54 has two recesses 180° part for receiving the ball. The unoccupied recess in FIG. 3 is numbered 55.

The refrigerator 10 is preferably designed for use with a cryogenic fluid such as helium but other fluids such as air and nitrogen may be used. The refrigerator 10 was designed to have a wattage output of at least 65 watts as 77° K. and a minimum of 5 watts at 20° K.

OPERATION-REFRIGERATION

As shown in FIG. 1, the displacer 18 is at bottom dead center. Vertical reciprocation of slide 60 is controlled by the rotative position of cam 48 and the cooperation between follower 58 and the slide groove receiving the follower. The spool valve member 80 is in its lowermost position with the spring 85 compressed due to contact between the end of valve member 80 and the cam 48. High pressure fluid is introduced from port 86, through groove 82, and passage 90 to the warm chamber 20. Port 92 is blocked by the valve member 80.

The function of the regenerator 26 is to cool the gas passing downwardly therethrough and to heat gas passing upwardly therethrough. In passage downwardly through the regenerator, the gas is cooled thereby causing the pressure to decrease and further gas to enter the system to maintain the maximum cycle pressure. The decrease in temperature of the gas in chamber 22 is useful refrigeration which is sought to be attained by the apparatus at heat station 24. As the gas flows upwardly through the regenerator 26, it is heated by the matrix to near ambient temperature thereby cooling the matrix. As the motor 34 rotates cam 48 counterclockwise in FIG. 2, and the displacer 18 is moved upwardly from bottom dead center, the surface of cam 48 controls the intake portion of the cycle. As the cam 48 continues to rotate, a peripheral portion thereof enables the valve member 80 to move upwardly under the pressure of spring 85 until valve member 80 closes off flow from port 86.

As the cam 48 continues to rotate, the slide 60 and displacer 18 continue to move upwardly. As the slide 60 approaches top dead center, cam 48 permits the valve member 80 to be reciprocated sufficiently upwardly so as to cause groove 82 to communicate passage 90 and port 92 and thereby commence the exhaust portion of the cycle. Timing of the exhaust portion of the cycle is controlled by the shape of the cam surface. As the cam 48 continues to rotate, it moves the valve member 80 downwardly until it is in contact with a portion of the cam surface which defines the time period for the introduction of high pressure gas from port 86. One complete cycle is now completed.

A typical embodiment operates at the rate of 72 to 80 cycles per minute. The reciprocatory movement of the displacer 18 and valve member 80 is synchronized to occur simultaneously in the same direction with the stroke of displacer 18 being greater than the stroke of valve member 80. Timing is predetermined by cam 38 so that valve member 80 and displacer 18 reciprocate at different rates. The length of stroke of the valve member 80 is short such as 9 to 12 mm with a 30 mm stroke for the displacer 18. Valve member 80 may be provided with an axial flow passage 83 communicating the pressure of chamber 98 to the chamber containing spring 85 whereby air is not compressed by the valve member each time it decends.

One problem with prior art devices is that the diameter of the slide bearing is only about 0.25 inches ID. The slide 60 and valve member 80 are each gas-balanced. This enables the ID of the clearance seal bearings 64, 68 to be 0.75 inches or 9 times as large with respect to surface area and hence only be subjected 1/9 the unit forces. Accordingly, the bearings will not wear out rapidly as is the case with the prior art devices.

The refrigeration available at heat station 24 may be used in connection with a wide variety of devices. One such device is a cryopump. The structural interrelationship disclosed results in positive control over the simultaneous movements of the slide 60 and valve member 80 so that introduction of high pressure gas and exhausting of low pressure gas is synchronized in a positive manner. Because high and low pressure gas is introduced or exhausted at the exact position of bottom dead center and top dead center for the slide 60, efficiency is increased with assurance of a complete introduction or exhaustion of a charge of gas.

HEAT PUMP

When a cryopump becomes saturated whereby it no longer absorbs noble gases, it heats up and puts a load on heat station 24. When the temperature of heat reaches about 20° K., a signal is initiated such as by a diode on the cryopump. It is thereafter necessary to apply heat to the cryopump. This can be accomplished by converting refrigerator 10 to a heating mode.

In order to cause refrigerator 10 to operate in a heating mode, it is only necessary to reverse the direction of rotation of motor 34 so that cam 48 rotates clockwise in FIG. 2. When motor 34 is operated in reverse, initially there is lost motion while pin 42 moves from one end of groove 44 to the other end and the ball detent moves from the recess shown in FIG. 3 to recess 55. Thereafter, motor 34 drives cam 48 and crank 54. Valve member 80 is now operated 180° out of phase with its operation during a refrigeration mode.

It is unexpected that a cryogenic refrigerator may become a heat pump merely by reversing the direction of rotation of a drive motor. In this manner a cryopump can be regenerated in 35 minutes as compared to conventional regeneration in $3\frac{1}{2}$ hours. A conventional diode on the cryopump may be used to trigger reversal of motor 34 at the beginning and end of the heating mode. Reversing the direction of motor 34 has no effect on its ability to reciprocate slide 60 and displacer 18 and does not change the area of the PV diagram.

The present invention may be embodied in other specific forms without departing from the spirit of essential attributes thereof and, accordingly, reference should be made to the appended claims, rather than to the foregoing specification, as indicating the scope of the invention.

I claim:

1. In a cryogenic apparatus in which a movable displacer means defines within an enclosure first and second chambers of variable volume, and in which a refrigerant fluid is circulated in a fluid path between the first chamber and the second chamber by movement of the displacer means, chamber means for guiding a slide connected to the displacer means, a reversible motor connected to said slide for reciprocating said slide, a valve having a reciprocable valve member for controlling the flow of high and low pressure fluid, said motor being connected to a cam arranged to reciprocate said valve member in timed relation with reciprocation of said slide so that the valve member will introduce high pressure fluid into said first and second chambers when the displacer means is at each of the extremities of its movement so that the apparatus is either a refrigerator or heat pump.

2. Apparatus in accordance with claim 1 including a roller bearing on the cam periphery and in contact with one end of said valve member which is gas-balanced, and spring means biasing said valve member into contact with said cam.

3. Apparatus in accordance with claim 1 wherein said cam is connected to the output of said motor by a 180° lost motion connection.

4. Apparatus in accordance with claim 3 wherein said lost motion connection includes a semi-circular groove which receives a pin, the groove being coaxial with the axis of the output shaft of said motor, the groove being on either of the cam or shaft with the pin being on the other of the cam and shaft.

5. Apparatus in accordance with claim 4 wherein said motor is connected to the slide by a crank, detent means between the crank and cam to maintain them in a predetermined orientation.

6. Apparatus in accordance with claim 1 including said displacer means having a regenerator therein, said slide being gas-balanced and having an axial flow passage communicating at one end with said regenerator, and ceramic clearance seal sleeve bearings for said slide, said bearings having an inner diameter of at least 0.5 inches.

7. In a cryogenic refrigerator in which a movable displacer means defines within an enclosure first and second chambers of variable volume, and in which a refrigerant is circulated in a fluid flow path between said first chamber and said second chamber in a manner correlated with movement of the displacer means, a slide connected to the displacer means, a valve for controlling flow of said fluid in said flow path, an electrical motor for controlling movement of said valve and being mechanically connected to said slide for controlling movement of said slide in timed relation with movement of said valve, means for causing the refrigerator to operate in a heating mode, said last-mentioned means including said motor being an electrical reversible motor for causing said valve to be operated 180° out of phase as compared when it is operated in a refrigeration mode.

8. Apparatus in accordance with claim 7 wherein said motor output includes a cam for controlling movement of said valve, and said motor output being coupled to said slide by way of a follower attached to the cam at a location on the cam which causes the valve to permit high pressure gas to enter said first and second chambers for operation as a refrigerator.

9. Apparatus in accordance with claim 7 wherein said valve includes a slidable valve member spring biased into contact with said cam.

10. Apparatus in accordance with claim 7 wherein said slide is of uniform cross-section at its ends and is gas balanced, said valve including a valve member which is gas-balanced.

11. A method of converting a cryogenic refrigerator to a source of heat comprising:

(a) generating a low temperature at a heat station of a refrigerator arranged for cooling an object, (b) step (a) including moving a displacer means and a valve member by an electric motor in a correlated manner, introducing high pressure gas into chambers of variable volume associated with said displacer means when the displacer means is at one extremity of its movement, (c) converting said refrigerator to a heat source for heating said object by reversing the direction of rotation of said motor and moving said valve member 180° out of phase as compared when it operated in step (a).

12. A method in accordance with claim 11 including using a cryopump as said object.

* * * * *